US005507107A

United States Patent [19]

Pinomäki

[11] Patent Number: 5,507,107

[45] Date of Patent: Apr. 16, 1996

[54] HOISTING BOOM ASSEMBLY

[76] Inventor: Sakari Pinomäki, Ollintie 7, FIN-33470 Ylöjärvi, Finland

[21] Appl. No.: 170,324

[22] PCT Filed: Jun. 22, 1992

[86] PCT No.: PCT/FI92/00194

§ 371 Date: Dec. 23, 1993

§ 102(e) Date: Dec. 23, 1993

[87] PCT Pub. No.: WO93/00286

PCT Pub. Date: Jan. 7, 1993

[51] Int. Cl.[6] ..... E02F 3/96

[52] U.S. Cl. ..... 37/403; 37/443; 212/300; 175/162; 172/126

[58] Field of Search ..... 37/403, 397, 407, 37/443; 212/188, 187; 175/203, 162; 172/126

[56] References Cited

U.S. PATENT DOCUMENTS

| | | | |
|---|---|---|---|
| 2,239,024 | 4/1941 | Vance | 175/162 |
| 3,367,514 | 2/1968 | Marklund et al. | 212/35 |
| 3,756,330 | 9/1973 | Russell, Jr. | 175/162 X |
| 3,828,939 | 8/1974 | Tranchero | 212/188 |
| 4,207,950 | 6/1980 | Kinzenbaw | 172/126 |
| 4,277,899 | 7/1981 | Güthoff | 37/443 |
| 4,703,811 | 11/1987 | Lam | 175/162 X |
| 4,953,638 | 9/1990 | Dunn | 175/162 X |
| 5,016,767 | 5/1991 | Thibault | 212/188 |
| 5,033,554 | 7/1991 | Younes | 175/203 X |
| 5,090,486 | 2/1992 | Jones | 175/203 X |
| 5,139,097 | 8/1992 | Rajala | 175/162 X |
| 5,139,157 | 8/1992 | Korthaus | 212/188 X |
| 5,197,615 | 3/1993 | Gunnarson | 212/188 X |
| 5,213,169 | 5/1993 | Heller | 175/162 X |
| 5,213,449 | 5/1993 | Morris | 175/162 X |
| 5,226,488 | 7/1993 | Lessard et al. | 175/162 X |

FOREIGN PATENT DOCUMENTS

| | | |
|---|---|---|
| 318382 | 9/1965 | Sweden . |
| 383991 | 4/1976 | Sweden . |
| 8804495-3 | 12/1988 | Sweden . |
| 90/14302 | 11/1990 | WIPO . |

*Primary Examiner*—Randolph A. Reese
*Assistant Examiner*—Victor Batson
*Attorney, Agent, or Firm*—Pollock, Vande Sande & Priddy

[57] ABSTRACT

A hoisting boom assembly comprises an upright column being piviotable by a rotary actuator and a first and second boom, the first boom pivotally mounted by its first end on upright column and by its second end on second boom; the second boom having its first section and its second section journalled to be pivotable in a vertical plane; a horizontal shift mechanism as well as a horizontal shift actuator for carrying the free end of the second boom in a horizontal direction; and an actuator fitted between upright column and the first boom for pivoting the first boom. In order to improve its performance, the hoisting boom assembly further includes compensating means for equalizing the forces caused by the operation of a hoisting boom assembly, particularly in situations following and preceding a first and/or a second extreme position assumed by a second boom.

10 Claims, 5 Drawing Sheets

HOISTING BOOM ASSEMBLY

BACKGROUND OF THE INVENTION

The present invention relates to a hoisting boom assembly, whose frame and actuators are to be coupled to a mobile working machine and which comprised an upright column or the like supported by the frame and at least partially rotatable around a vertical axis by means of a rotary actuator, a second boom having its first section pivotably journalled in a vertical plane, a horizontal shift mechanism and a horizontal shift actuator for shifting the free end of the second boom in a horizontal direction, the horizontal shift mechanism being adapted to act between a first boom and the sections of the second boom so that the horizontal shift mechanism can be operated between the sections of the second boom independently of the position of the first boom; the first boom being fitted between the upright column or the like and the second boom and having its first end pivotally mounted on the upright column or the like, preferably on the top section thereof, and having its second end pivotally mounted on the second boom; and an actuator fitted between the upright column or the like and the first boom for pivoting the first boom in vertical plane relative to the upright column or a like.

When manipulating the hoisting boom assembly, the operating range of the second boom is defined so that in a first extreme position of the second boom the longitudinal direction of its second section is substantially parallel to the longitudinal direction of its first section, the second section serving as an extension or a jib for the first section and, in a second extreme position of the second boom, the longitudinal direction of its second section is substantially opposite to the longitudinal direction of the first section, the second section being thus preferably tangential to the first section. A particular object of the present invention is a hoisting boom assembly suitable for for example, use in drilling operations in addition to being used with a loading harvester.

In the past, a loading harvester has been generally fitted with a hoisting boom assembly provided with two booms, a lifting boom and a carrier boom. When this type of hoisting boom assembly is operated to carry a load in the direction of a crane, it is necessary to operate both the lifting and the carrier boom. This results in a complicated operation of the hoisting boom assembly. In order to achieve a major operating range or reach, the carrier boom generally comprises a telescopic boom. However, this results in a heavy overall hoisting boom assembly, and particularly the passage of a pressure medium or hydraulic fluid to the end of a boom assembly is technically difficult to carry out.

In order to eliminate the above drawbacks, for example, the SE Publication 383 991 discloses hoisting boom assemblies operating in such a manner that a single actuator, especially a hydraulically operated cylinder-piston aggregate, is used to produce a linear movement a horizontal direction. In the prior known hoisting boom assemblies, this boom arrangement is journalled directly to an upright column which is in turn coupled with the body of a mobile working machine, such as a tractor. A drawback of this structure is, however, that the boom assembly is very long and has a high center of gravity. A high center of gravity results from the fact that the upright column must be sufficiently long in order that the hoisting boom assembly can be pivoted to lie above the operator's cabin in a transporting position.

The Applicant's Finnish Patent No. 82826, entitled "Hoisting boom assembly", discloses a solution which is further developed relative to the prior art hoisting boom constructions, such as those mentioned above. Unlike the other prior art, this patent discloses a hoisting boom assembly, comprising a first boom fitted between an upright column and a second boom and having its first end pivotally mounted on the upright column and its second end pivotally mounted on the second boom, an actuator fitted between the upright column and the first boom for pivoting the first boom in a vertical plane relative to the upright column, and the hoisting boom assembly including a horizontal shift mechanism which is adapted to act between the first boom and the sections of the second boom so that it is possible to operate the horizontal shift mechanism between the sections of the second boom independently from the position of the first boom.

The principal benefits gained by the above solution over the prior art include among other things the following aspects. The vertical shifts of a load carried on the free end of a second section can be effected by pivoting the first boom in a vertical plane. An actuator acting between the upright column and the first boom is sufficient for carrying out this function. The horizontal shifts of a load can be effected with a pivoting movement of the second boom sections in the vertical plane by utilizing a horizontal shift mechanism and a horizontal shift actuator. In practical applications, the hoisting boom assembly will have a low center of gravity particularly for the reason that the assembly includes a first boom, whose pivoting movement in a vertical plane can be used for shifting the center of gravity of the hoisting boom assembly to a position most advantageous in view of operation. Thus the hoisting boom assembly can be laid on top of a mobile working machine, such as a tractor, in a transporting position, whereby the first boom is lifted to an upright position to extend parallel to the upright column. In order to facilitate this, the sections of the second boom are pivoted to lie parallel to and on top of each other in a horizontal direction and, thus, these sections can be laid in the longitudinal direction of a working machine by pivoting the upright column to a position appropriate for this purpose.

A hoisting boom assembly disclosed in the Applicant's above-cited earlier Patent has proved practically useful and, thus, it has achieved a firm foothold on a market for hoist assemblies. Its undeniable advantages over the prior art solutions include the simplicity and reliability of both its construction and application. However, in certain practical situations, for example when carrying a load in a suitably inclined position of a working machine, there has been found a problem that the best controllability of a hoisting boom assembly is not possible in all conditions. Thus, especially with a hoisting boom assembly in its second extreme position, when the first and second section of the second boom are completely pivoted into contact with each other, a result of a load carried by the hoisting boom assembly is that, when manipulating the hoisting boom assembly, the sections of the second boom have a quite substantial traveling speed in situations following or preceding the second extreme position and, thus, the forces acting in the hoisting boom assembly are quite substantial. Thus, the operator of a hoisting boom assembly is required to have professional skill and accuracy for controlling the operation of a hoisting boom assembly so that excessive travelling speeds and abrupt halts are avoided.

The above drawback occurs due to the fact that a first transmission rod included in the horizontal shift mechanism and a horizontal shift actuator included in the horizontal shift mechanism are pivotally mounted at the same point. Thus, in the second extreme position of the second boom, the horizontal shift actuator extends in a direction nearly identical to that of the first and second section of the second boom, whereby an active force produced by the horizontal shift actuator includes a component force directed perpendicularly to the sections of the second boom and having an opening effect, this component force being very small relative to a component force parallel to the sections of a hoisting boom. Thus, the horizontal shift actuator does not function in an ideal fashion, since a force effect produced thereby is unfavorable particularly in the second extreme position of the second boom. Such disposition of a horizontal shift actuator also results in that, depending on the lead carried by the hoisting boom assembly, the travelling speeds of the sections included in the hoisting boom assembly in situations close to the second extreme position vary to a great degree due to the major forces of the horizontal shift actuator. Thus, the function of a hoisting boom assembly must be known in detail in order to relate the operation of a horizontal shift actuator to various loads.

SUMMARY OF THE INVENTION

An object of a hoisting boom assembly of this invention is to provide a decisive improvement and elimination of the above drawbacks of the available prior art. In order to achieve this object, a hoisting boom assembly of the invention is principally characterized in that, for improving its operation the hoisting boom assembly comprises compensating means for equalizing the forces created by the movement of the hoisting boom assembly at least within the operating range of a second boom, particularly in situations substantially following and preceding the first and/or second extreme position of the second boom, whereby the first section and the second section are pivoting away from or towards each other.

One of the most important benefits gained by the hoisting boom assembly of the invention is particularly the controllability of its operation on various loads. Thus, the hoisting boom assembly designed according to the invention is readily controllable in all conditions, whereby the operator of such hoisting boom assembly is not required to apply special alertness or professional skill for its operation. This is by virtue of the fact that, over the entire operating range of the hoisting boom assembly, its operating speed as well as the component forces created by operating the hoisting boom assembly over that range, can be compensated according to the invention in a manner superior to what can be achieved at present. Thus, the invention facilitates the ideal operation of a hoisting boom assembly particularly in difficult conditions as well as stressed under varying loads.

BRIEF DESCRIPTION OF THE DRAWINGS

The invention will now be described in more detail with reference made to the accompanying drawings, in which.

DETAILED DESCRIPTION OF THE PREFERRED EMBODIMENT

Figure 1:
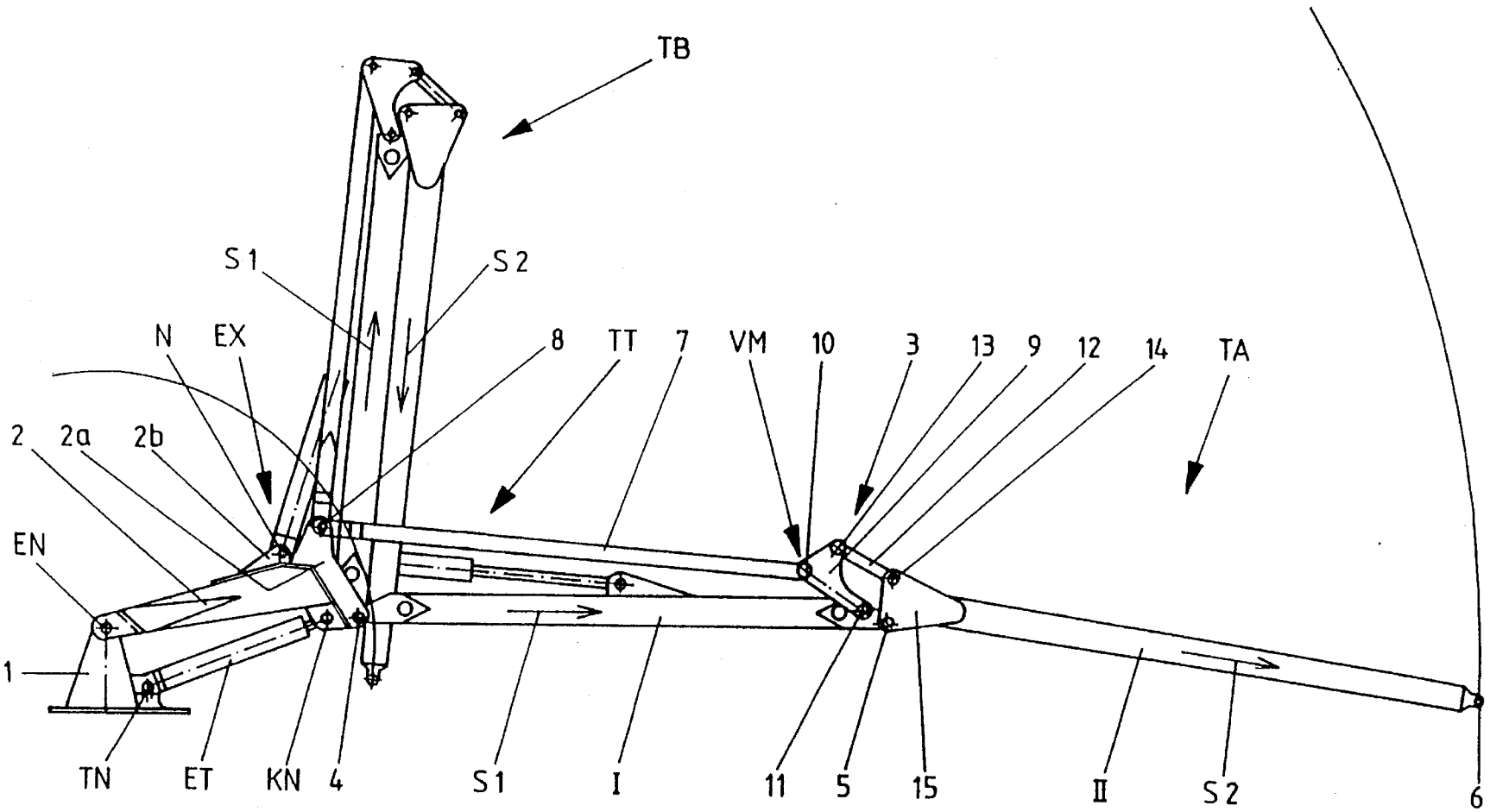
FIG. 1 is a side view showing a first embodiment of a hoisting boom assembly of the invention in a first TA and a second TB extreme position of its second boom.

The invention relates to a hoisting boom assembly having its frame R and actuators KT, ET, TT coupled to a mobile working machine TR. The hoisting boom assembly comprises an upright column 1 supported by frame R and pivotable around a vertical axis by means of a rotary actuator KT; a second boom 3 having its first section I journalled pivotably at point 4 in vertical plane and having its second section II journalled at point 5 to first section I also pivotably in a vertical plane; a horizontal shift mechanism VM as well as a horizontal shift actuator TT for carrying a free end 6 of the second boom 3 in a horizontal direction; a first boom 2 fitted between upright column 1 and second boom 3 and journalled at EN by its first end to upright column 1, preferably to the top section thereof, and journalled at 4, 8 by its second end to second boom 3; and an actuator ET fitted between the upright column 1 and the first boom 2 for pivoting said the first boom 2 in a vertical plane relative to the upright column 1. To improve its operation, the hoisting boom assembly further includes compensating means EX for equalizing the forces created by operating the hoisting boom assembly, especially in situations following and preceding the first and/or second extreme position TA, TB of the second boom 3, wherein its first section I and second section II are pivoted away from or towards each other.

Figure 2:
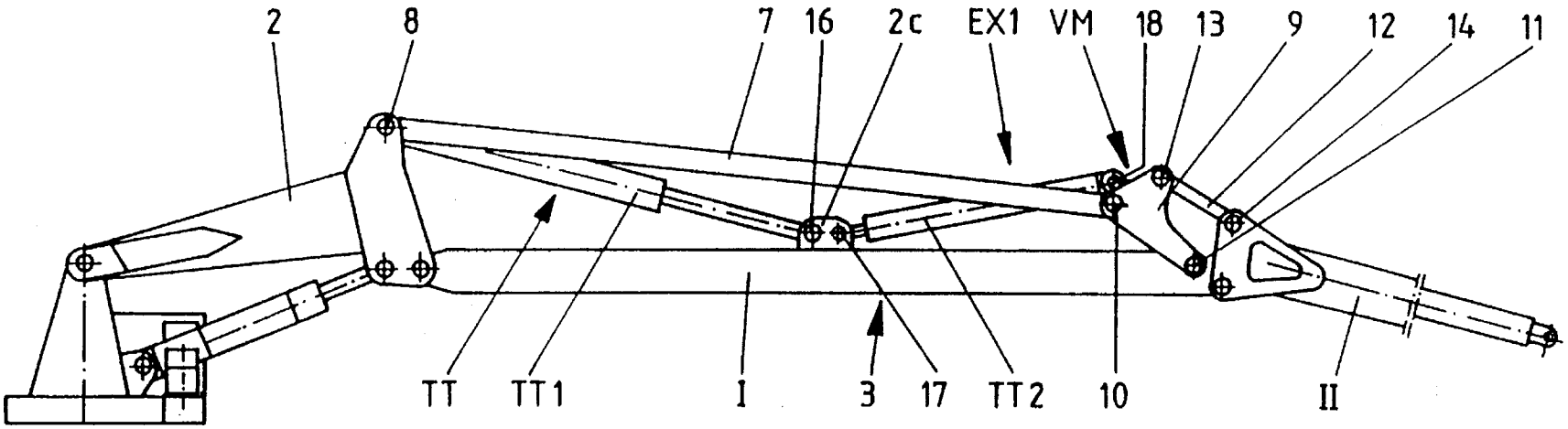
FIG. 2 is a side view showing a second embodiment of a hoisting boom assembly of the invention.
Figure 3:
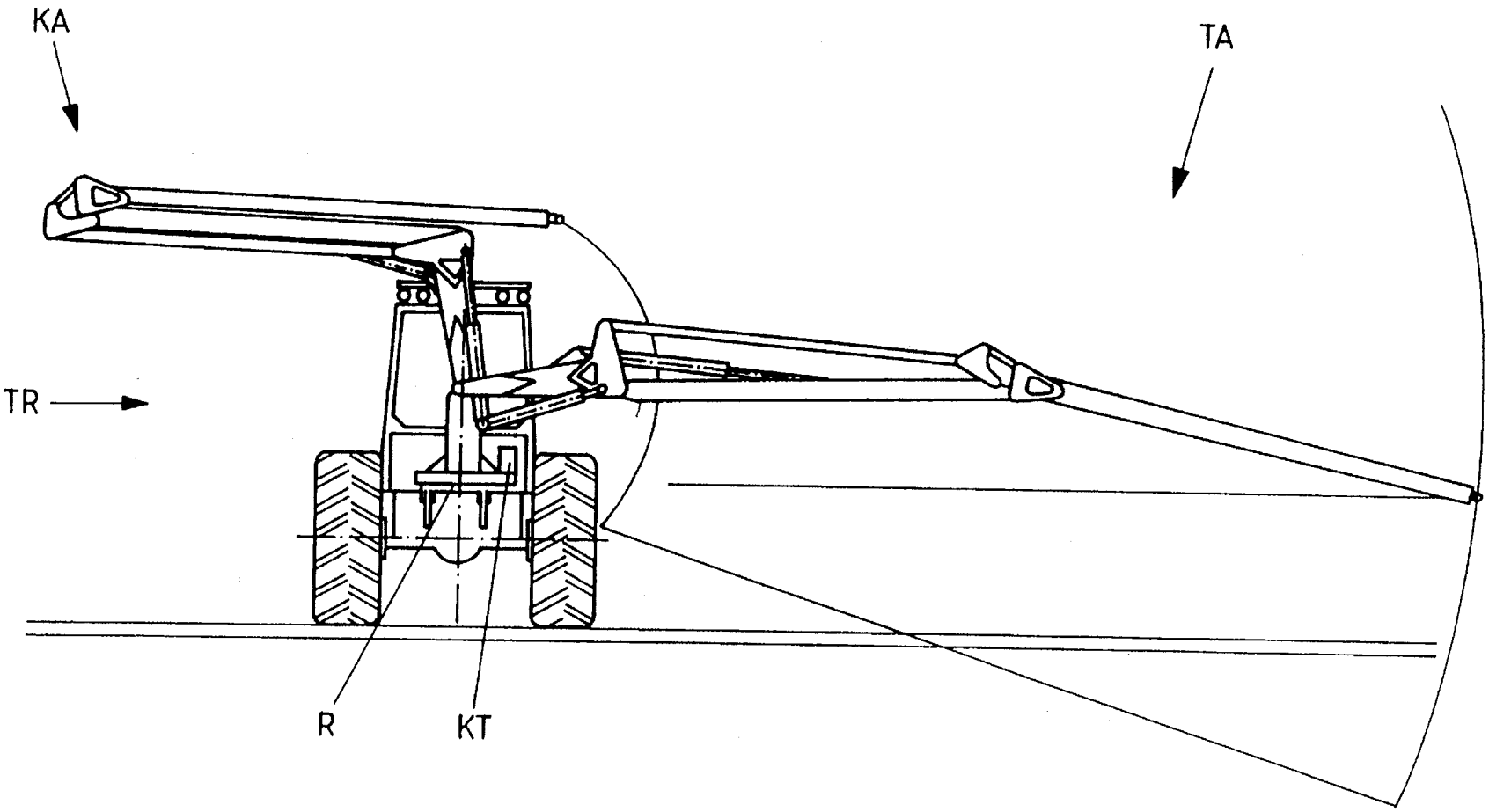
FIG. 3 shows the first embodiment of a hoisting boom assembly of the invention, wherein the hoisting boom assembly is shown both in an operating position TA and in a transporting position KA and wherein the hoisting boom assembly is mounted on the rear section of a working machine TR, such as a tractor.

As shown in FIGS. 1–3, the horizontal shift mechanism VM is adapted to exert action between the first boom 2 and sections I, II of the second boom 3 so that the operation of horizontal shift mechanism VM is possible between sections I, II of the second boom 3 regardless of the position of the first boom 2. The operating range of the second boom 3 included in the hoisting boom assembly is such that, in the first extreme position TA the second boom 3, the longitudinal direction S2 of its second section II is substantially parallel to the longitudinal direction S1 of the first section I, the second section II serving as an extension or a jib for first section I and, in the second extreme position TB of second boom 3, the longitudinal direction of its second section II lies in contact with first section I, essentially tangential to first section I.

In the first embodiment of a hoisting boom assembly of the invention shown in FIG. 1, one of the ends of first boom 2 is at one point 8 pivotally fitted with a first transmission rod 7 included in the horizontal shift mechanism VM. In this embodiment, the compensating means EX are included for equalizing the forces created by the operation of the hoisting boom assembly within both extreme positions TA, TB of the second boom 3.

Thus, the compensating means EX are provided by positioning a pivoting point N, which links a horizontal shift actuator TT, included in horizontal shift mechanism VM and connected with first section I of second boom 3, to first boom 2 and whose location is substantially different from that of pivoting point 8, the pivoting point N being located at a substantially smaller distance from a pivoting point EN linking upright column 1 and first boom 2 than the pivoting point 8 linking first transmission rod 7 and first boom 2.

Hence, the compensation of forces prevailing in the hoisting boom assembly in the extreme positions of the second boom 3 is based on the fact that, both in its first extreme position TA and in its second extreme position TB, the directions of component forces caused by the horizontal shift actuator TT are nearly identical. Thus, unlike the prior art solution, wherein pivoting point N had the same location as pivoting point 8, the hoisting boom assembly operates in an identical fashion in situations of both extreme positions TA, TB thereof. This also contributes to the equalization of the operating speeds of a hoisting boom assembly, since in both extreme positions TA, TB, the corresponding strokes of the horizontal shift actuator TT serve to produce a corresponding movement of the hoisting boom assembly.

In the embodiment of FIG. 1, one of the ends of first boom 2 is provided with a first lug 2*a* which is fitted with the pivoting point 8 for linking first transmission rod 7 and first boom 2. Thus, as one preferred embodiment, the first lug 2*a* is designed so that the horizontal shift actuator TT operates inside the first lug 2*a* in a space between the pivoting point 8 and the first boom 2. In addition, the pivoting point N for linking horizontal shift actuator TT and first boom 2 is located in a second lug 2*b* of the first boom 2.

FIG. 2 illustrates a second embodiment for a hoisting boom assembly of the invention, wherein a horizontal shift mechanism VM for the hoisting boom assembly comprises, similar to the first embodiment shown in FIG. 1, a multi-link element 9 which is pivoted to a first transmission rod 7 by means of a link 10, to a first section I included in second boom 3 by means of a link 11, and to a second transmission rod 12 pivoted at 14 to a second section II included in second boom 3 by means of a link 13. Thus, the compensating means EX 1 are included for equalizing the forces prevailing in the horizontal shift actuator TT especially in the second extreme operating range TB of second boom 3. Hence, the compensating means EX are designed to include a horizontal shift actuator TT which consists of two actuating means TT1, TT2, such as a pressure-medium operated cylinder or the like.

The first and second actuating means TT1, TT2 of the horizontal shift actuator TT are mounted to operate successively, in substantially diverging directions of action, essentially in the same vertical plane. Actuating means TT1, TT2 are pivotally mounted the first boom 2, on the first section I of the second boom 3, and on the horizontal shift mechanism VM. The first actuating means TT1 is linked by its first end to a pivoting point 8 connecting transmission rod 7 and first boom 2 and by its second end to a pivoting point 16, located on a third lug 2*c* associated with first section I of second boom 3. The second actuating means TT2 is linked by its first end to a pivoting point 17 included in third lug 2*c* and by its second end to a pivoting point 18 of multi-link element 9.

Thus, the second embodiment offers a solution capable of equalizing the forces caused by the operation of a hoisting boom assembly, especially in the second extreme position TB, on two separate actuating means TT1, TT2 included in horizontal shift actuator TT. However, this type of solution does not offer the same benefits as the first embodiment, since the force effect of power transmission is clearly more advantageous in first extreme position TA than in second extreme position TB. Thus, it is natural that neither can the corresponding advantages be gained in terms of the controllability of the hoisting boom assembly as readily as in the first embodiment.

FIG. 3 illustrates the hoisting boom assembly according to the first embodiment mounted on the rear section of a tractor TR, the assembly being shown in one of its operating positions TA and in its transporting position KA.

Figure 4:
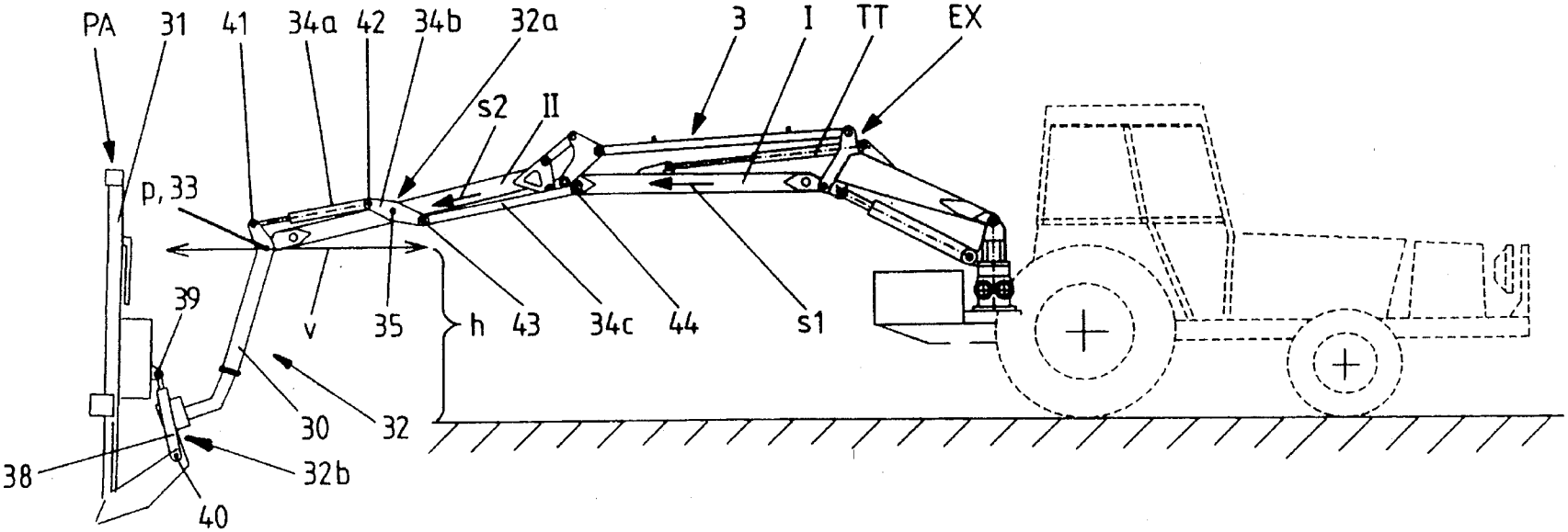
FIG. 4 is a side view of a preferred embodiment for the hoisting boom assembly of the invention, which is equipped for use as a support for a drilling device.
Figure 5:
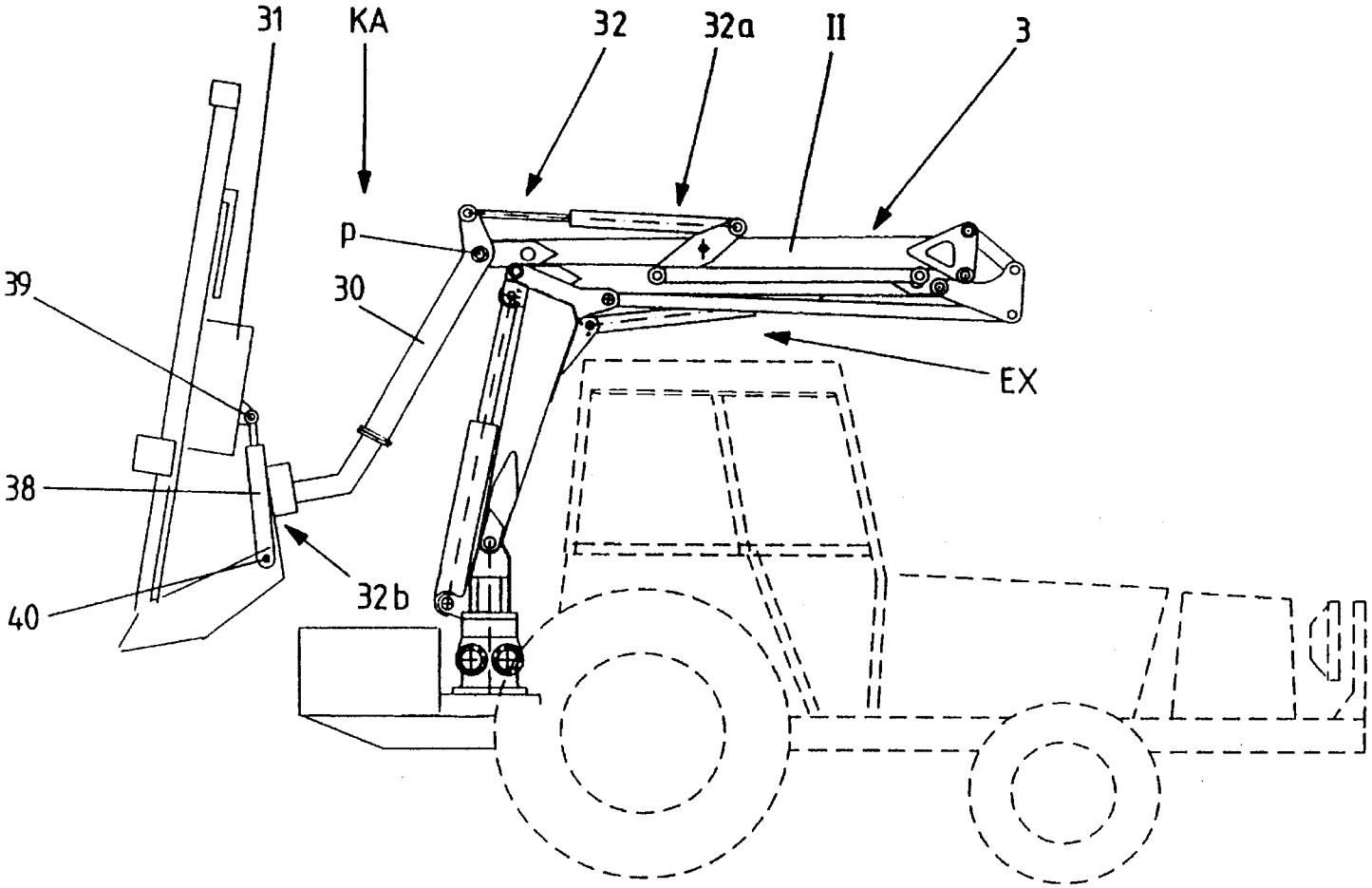
FIG. 5 shows the embodiment shown in FIG. 4 in the transporting position KA.

As a result of continuous product development, the hoisting boom assembly as described above has been found to be suitable, thanks to compensating means EX, not only for use with a harvester but also particularly well for use as a support in drilling operations. Thus, as shown in FIGS. 4 and 5, an auxiliary frame is connected to the end P of the second section II of the second boom 3, supporting a drilling device 31 in the hoisting boom assembly. Because of the compensating means EX, the hoisting boom assembly is sufficiently firm in the whole travelling range of the hoisting boom assembly both during movement of the hoisting boom assembly and the relatively massive drilling device supported by the same and during drilling by the drilling device, the hoisting boom assembly being immobile.

For this purpose, the drilling device 31 connected to the hoisting boom assembly is movable in relation to the hoisting boom assembly by means of tilting means 32 effective between the hoisting boom assembly and the drilling device 31. Using the first means 32*a* of the tilting means 32, the operating position PA shown, for example, in FIG. 4 is kept stable in relation to the ground by tilting the auxiliary frame 30 as the end P of the second section II of the second boom 3 of the hoisting boom assembly travels in substantially horizontal plane v. In the preferred embodiment described above, the first means 32*a* are formed of the lever arm arrangement 34*a*, 34*b*, 34*c* connecting the auxiliary frame 30 and the first section I of the second boom 3 of the hoisting boom assembly.

Thus, the first end of the auxiliary frame 30, which is pivotably at point 33 connected to the end P of the hoisting boom assembly, is connected by a journalled at 41, 42 hydraulic cylinder 34*a* to the first end of the lever 34*b* journalled at 35 to the middle part of the second section II of the second boom 3, the second end of the lever 34*b* being journalled at point 43 to the lever arm 34*c* whose other end is journalled at 44 to the end of the first section I of the second boom 3. During use of the hoisting boom assembly in a situation shown in FIG. 4, the lever arm arrangement 34*a*, 34*b*, 34*c* effects that the position of the drilling device 31 remains stable as the end P of the hoisting boom assembly is moved by the actuator TT in the operating height h in the horizontal plane v, whereby the longitudinal directions s1, s2 of the first and second sections I, II of the second boom 3 are changed in relation to each other.

It is possible by the hydraulic cylinder 34*a* used in the lever arm arrangement, for example, to adjust the lever ratio to be suitable for different operating heights h. In addition, it is possible by the hydraulic cylinder 34*a* to place the auxiliary frame 30 in a preferred transporting position KA shown in FIG. 5. Naturally hydraulic cylinder 34*a* and lever arm 34*c* can be replaced by each other in position. It is also possible to use a hydraulic cylinder instead of lever arm 34*c*, or correspondingly use only two or more solid lever arms, in which case the lever ratio is changed, for example, by mechanical arrangements.

In the preferred embodiment above, the auxiliary frame 30 is further fitted with second means 32*b* of the tilting means 32. By these second means 32*b* effective between drilling device 31 and auxiliary frame 30, it is possible to adjust, for example, the drilling direction of drilling device 31 in the operating position PA or, in a situation shown in FIG. 5, to place drilling device 31 in a preferred position in transporting position KA, the hoisting boom assembly being immobile. Second means 32*b* are formed of a hydraulic cylinder 38, which is pivotably journalled at 40, 39 connected to auxiliary frame 30 and drilling device 31 for changing the position of the same by at least tilting drilling device 31 in a substantially vertical position. Second means **32*b*** can naturally comprise several hydraulic cylinders, in case it is necessary to tilt the drilling device in planes different from the vertical plane defined by the hoisting boom assembly.

It is obvious that the invention is not limited to the above embodiments but it can be modified to a great deal within the basic concept because of an extensive overall construction covered by a hoisting boom assembly.

I claim:

1. A hoisting boom assembly comprising:

an upright column rotatable around a vertical axis and a first and a second boom;

said first boom having a first end pivotally mounted on said upright column and a second end pivotally connected to said second boom;

said second boom being made up of a first and a second section, said first section being pivotable in a vertical plane and said second section being journalled to said first section and pivotable in said vertical plane;

the operating range of said second boom being defined between a first extreme position in which longitudinal directions of its first and second section are substantially parallel to each other and, a second extreme position in which the longitudinal directions of its first and second section are substantially opposite to each other;

an actuator fitted between said upright column and said first boom for pivoting said first boom in a vertical plane relative to said upright column;

a horizontal shift mechanism and a horizontal shift actuator for shifting a free end of said second boom in a horizontal direction, said horizontal shift mechanism operating between said first and second sections of said second boom independently of the position of said first boom;

compensating means for equalizing forces created by the movement of said hoisting boom assembly at least when said second boom is close to said first and second extreme position, said compensating means being formed by combining a horizontal shift actuator, included in said horizontal shift mechanism and connected at one end to said first section of said second boom, and at the other end to said first boom at a first pivoting point substantially spaced from a second pivoting point linking a first transmission rod forming a part of said horizontal shift mechanism and said first boom;

an auxiliary frame connected to said hoisting boom assembly for movably supporting a drilling device;

tilting means including a first means for tilting said auxiliary frame due to the movement of the hoisting boom assembly;

said first means being formed of a lever arm arrangement for connecting said auxiliary frame by a first pivotal lever arm to a first end of a lever member which is rotatably connected to a middle part of said second section of said second boom, the lever member being further connected at its other end by a second pivotal lever arm to the end of said first section of said second boom.

2. A hoisting boom assembly according to claim 1, wherein said first pivoting point linking said horizontal shift actuator and said first boom is located at a substantially smaller distance from a third pivoting point linking said upright column and said first boom than said second pivoting point linking said transmission rod and said first boom.

3. A hoisting boom assembly according to claim 2 wherein one of the ends of said first boom is provided with a first lug which is fitted with said second pivoting point linking said first transmission rod and said first boom, said first lug being so designated that said horizontal shift actuator operates in a space inside said first lug between said pivoting point and said first boom, whereby said first pivoting point linking said horizontal shift actuator and said first boom is arranged on a top surface of said first boom.

4. A hoisting boom assembly according to claim 3 wherein said first boom is pivoted by a second lug which is fitted with said first pivoting point linking said horizontal shift actuator and said first boom.

5. A hoisting boom assembly according to claim 1 wherein a first and a second actuating means are adapted to operate successively in substantially diverging directions of action and substantially in the same vertical plane, and are pivotally mounted on said first boom, said first section of said second boom and on said horizontal shift mechanism.

6. A hoisting boom assembly according to claim 5 wherein said first actuating means of said horizontal shift actuator is pivotally connected at its first end to said second pivoting point linking said first transmission rod and said first boom and at its second end to a fourth pivoting point provided on a third lug connected to said first section of said second boom, said second actuating means being pivotally connected at a first end to a fifth pivoting point provided on said third lug at its second end to a sixth pivoting point provided on said multi-link element.

7. A hoisting boom assembly according to claim 1 wherein at least one of said first and second lever arms, is formed of at least one actuator for changing the distance between their pivoting points.

8. A hoisting boom assembly according to claim 1 wherein at least the operating position of the drilling device is changeable as the hoisting boom assembly is stable, and wherein said tilting means includes second means adapted to tilt said drilling device in relation to said auxiliary frame.

9. A hoisting boom assembly according to claim 8 wherein the second means of tilting means comprise an actuator, which is journalled to said drilling device and said auxiliary frame at pivoting points and is able to change the distance between its pivoting points by an auxiliary force.

10. A hoisting boom assembly comprising:

an upright column rotatable around a vertical axis and a first and a second boom;

said first boom having a first end pivotally mounted on said upright column and a second end pivotally connected to said second boom;

said second boom being made up of a first and a second section, said first section being pivotable in a vertical plane and said second section journalled to said first section and pivotable in said vertical plane;

the operating range of said second boom being defined between a first extreme position in which longitudinal directions of its first and second section are substantially parallel to each other and, a second extreme position in which the longitudinal directions of its first and second section are substantially opposite to each other;

an actuator fitted between said upright column and said first boom for pivoting said first boom in a vertical plane relative to said upright column;

a horizontal shift mechanism and a horizontal shift actuator for shifting a free end of said second boom in a horizontal direction, said horizontal shift mechanism operating between said first and second sections of said second boom independently of the position of said first boom;

wherein said horizontal shift mechanism comprises a multi-link element which is pivotally mounted to a first transmission rod by a first link, and to said first section of said second boom by a second link;

compensating means for equalizing forces created by the movement of said hoisting boom assembly at least when said second boom is close to its first and second extreme position, said compensating means being formed by designing said horizontal shift actuator with at least two actuating means which are in at least a power transmitting communication with said first boom, and at least one of said second boom and said horizontal shift mechanism;

an auxiliary frame connected to said hoisting boom assembly for movably supporting a drilling device;

tilting means including a first means for tilting said auxiliary frame due to the movement of the hoisting boom assembly;

said first means being formed of a lever arm arrangement for connecting said auxiliary frame by a first pivotal lever arm to a first end of a lever member which is rotatably connected to a middle part of said second section of said second boom, the lever member being further connected at its other end by a second pivotal lever arm to the end of said first section of said second boom.

* * * * *

UNITED STATES PATENT AND TRADEMARK OFFICE

CERTIFICATE OF CORRECTION

PATENT NO. : 5,507,107
DATED : April 16, 1996
INVENTOR(S) : Sakari Pinomäki

It is certified that error appears in the above-identified patent and that said Letters Patent is hereby corrected as shown below:

On the title page:

[30] Foreign Application Priority Data

--June 27, 1991 [CA] Canada .....2,045,822

Signed and Sealed this

Twenty-second Day of October, 1996

*Attest:*

Bruce Lehman

BRUCE LEHMAN

*Attesting Officer*

*Commissioner of Patents and Trademarks*